US005283030A

United States Patent [19]

Nakano et al.

[11] Patent Number: 5,283,030

[45] Date of Patent: Feb. 1, 1994

[54] COATED CEMENTED CARBIDES AND PROCESSES FOR THE PRODUCTION OF SAME

[75] Inventors: Minoru Nakano; Toshio Nomura, both of Itami, Japan

[73] Assignee: Sumitomo Electric Industries, Ltd., Osaka, Japan

[21] Appl. No.: 957,100

[22] Filed: Oct. 7, 1992

Related U.S. Application Data

[62] Division of Ser. No. 634,549, Dec. 27, 1990, Pat. No. 5,181,953.

[30] Foreign Application Priority Data

| | | | |
|---|---|---|---|
| Dec. 27, 1989 | [JP] | Japan | 1-344521 |
| Dec. 27, 1989 | [JP] | Japan | 1-344522 |
| Dec. 28, 1989 | [JP] | Japan | 1-344508 |
| Dec. 21, 1990 | [JP] | Japan | 2-412717 |

[51] Int. Cl.[5] ..... B22F 3/02; B22F 3/12; B22F 7/02; B05D 3/02

[52] U.S. Cl. ..... 419/53; 419/10; 419/13; 419/15; 419/38; 419/54; 419/57; 427/314; 427/318

[58] Field of Search ..... 419/45, 10, 13, 14, 419/15, 16, 29, 38, 53, 54, 55, 56, 57; 427/299, 304, 314, 327, 318

[56] References Cited

U.S. PATENT DOCUMENTS

| | | | |
|---|---|---|---|
| 4,318,733 | 3/1982 | Ray et al. | 75/0.5 BA |
| 4,497,874 | 2/1985 | Hale | 428/551 |
| 4,649,084 | 3/1987 | Hale et al. | 428/552 |

FOREIGN PATENT DOCUMENTS 0182759 5/1986 European Pat. Off. .

*Primary Examiner*—Donald P. Walsh
*Assistant Examiner*—Daniel Jenkins
*Attorney, Agent, or Firm*—Wenderoth, Lind & Ponack

[57] ABSTRACT

A coated cemented carbide alloy, excellent in toughness as well as wear resistance and which is used for cutting tools and wear resistance tools is provided herein. This coated cemented carbide alloy is composed of a cemented carbide substrate consisting of a hard phase of at least one member selected from carbides, nitrides and carbonitrides of the Group IVb, Vb and VIb metals of Periodic Table and a binder phase consisting of at least one member selected from the iron group metals, and a monolayer or multilayer provided on the substrate consisting of at least one member selected from the carbides, nitrides, oxides and borides of Group IVb, Vb and VIb metals of Periodic Table, solid solutions thereof and aluminum oxide, and wherein a binder phase-enriched layer is provided in a space 0.01 mm and 2 mm below the surface of the substrate with A-type and/or B-type pores inside the binder phase-enriched layer.

3 Claims, 3 Drawing Sheets

COATED CEMENTED CARBIDES AND PROCESSES FOR THE PRODUCTION OF SAME

This is a divisional application of Ser. No. 07/634,549, filed Dec. 27, 1990,now U.S. Pat. No. 5,181,953.

BACKGROUND OF THE INVENTION

1. Field of the Invention

This invention relates to a coated cemented carbide alloy which is very excellent in toughness as well as wear resistance and which is used for cutting tools and wear resistance tools.

2. Description of the Prior Art

A surface-coated cemented carbide comprising a cemented carbide substrate and a thin film such as titanium carbide, coated thereon by vapor-deposition from the gaseous phase, has widely been used for cutting tools and wear resistance tools with higher efficiency. This is superior to the non-coated cemented carbides of the prior art, because the substrate exhibits high toughness and the surface has excellent wear resistance.

Of late, an increase in the efficiency of the cutting efficiency has been achieved. Since the cutting efficiency is determined by the product of the cutting speed (V) and the feed quantity (f) and since an increase of V causes elevation of the edge temperature, resulting in rapid shortening of the tool life, it has hitherto been proposed to increase the feed f to improve the cutting efficiency. In this case, however, a substrate having a higher toughness is required for dealing with the high cutting stress. To this end, there have been developed alloys wherein the quantity of a binder phase (Co) is increased and wherein the quantity of Co is increased only in the surface layer of the alloy. Moreover, a increase of the cutting speed (V) has lately been taken into consideration in respect to the feed f. In this case, there arises a problem that when the quantity of Co is increased, deformation of the cutting edge is increased at a higher cutting speed, so the tool life is shortened, while when that of Co is decreased, breakage tends to occur at a higher feed quantity (f).

As a wear resistance and impact resistance tool, WC-Co alloys have been used and improvement of the wear resistance or toughness thereof has been carried out by controlling the grain size of WC powder and the quantity of Co, in combination. However, the wear resistance and toughness are conflicting properties, so if Co is increased so as to produce a high toughness in the above described WC-Co alloy, the wear resistance is lowered.

Therefore, the use of WC-Co alloys as a wear and impact resisting tool is necessarily more limited as compared with HSS type alloys (abbreviation of high speed steel). Thus, alloys obtained by replacement of Co thereof by Ni or replacement of WC thereof by (Mo, W)C have also been taken into consideration but the fundamental problems have not been solved.

Japanese Patent Laid-Open Publication No. 179846/1986 discloses an alloy in which the $\eta$ phase is allowed to be present in the interior of the alloy and a binder phase is enriched outside it. However, this alloy has disadvantages in that because of the presence of a brittle phase, i.e., $\eta$ phase inside, the impact resistance, at which the present invention aims, is lacking and when the quantity of the binder phase is high in this alloy, dimensional deformation tends to occur due to reaction with a packing agent such as alumina.

SUMMARY OF THE INVENTION

It is an object of the present invention to provide a surface-coated cemented carbide suitable for use as cutting tools and wear resisting tools, whereby the disadvantages of the prior art can be overcome.

It is another object of the present invention to provide a tool capable of maintaining an excellent wear resistance and toughness under conditions of high efficiency, that the prior art cannot attain.

These objects can be attained by a surface-coated cemented carbide comprising a cemented carbide substrate consisting of a hard phase of at least one member selected from the group consisting of carbides, nitrides and carbonitrides of Group IVb, Vb and VIb metals of the Periodic Table and a binder phase consisting of at least one member selected from the iron group metals, and a monolayer or multilayer, provided thereon, consisting of at least one member selected from the group consisting of carbides, nitrides, oxides and borides of Group IVb, Vb and VIb metals of the Periodic Table, solid solutions thereof and aluminum oxide, in which a binder phase-enriched layer is provided in a space between 0.01 mm and 2 mm below the surface of the substrate.

BRIEF DESCRIPTION OF THE DRAWINGS

The accompanying drawings are to illustrate the principle and merits of the present invention in greater detail.

DETAILED DESCRIPTION OF THE INVENTION

The important features of the present invention are summarized below:

(1) In a cemented carbide comprising a cemented carbide substrate consisting of a hard phase of at least one member selected from the group consisting of carbides, nitrides and carbonitrides of Group IVb, Vb and VIb metals of the Periodic Table and a binder phase consisting of at least one member selected from the iron group metals, the quantity of the binder phase between 0.01 mm and 2 mm below the surface of the substrate is enriched and A-type pores and B-type pores are formed inside the binder phase-enriched layer.

(2) The surface part of the cemented carbide has the following hardness distribution:

(a) A zone showing a moderate lowering of the hardness toward the inside from the surface.

(b) A zone showing a rapid lowering of the hardness, following after Zone (a).

(c) A zone showing a minimum value of the hardness and an increased hardness toward the inside where there is a small change of the hardness, following after zone (b).

(3) In the cemented carbide comprising WC and an iron group metal, at least one member selected from the group consisting of Ti, Ta, Nb, V, Cr, Mo, Al, B and Si is incorporated in the binder phase to form a solid solution in a proportion of from 0.01% by weight to the upper limit of the solid solution and in the outside part of the surface of the cemented carbide, there are formed a layer in which the quantity of the binder phase is less than the mean value of the quantity of the binder phase inside the cemented carbide and a layer in which the quantity of the binder phase is increased between the above described layer and the central part of the cemented carbide.

(4) The quantity of the binder phase is reduced to less than in the zone from the surface to the binder phase-enriched layer than the mean quantity of the binder phase in the interior part of the cemented carbide.

Figure 5A:
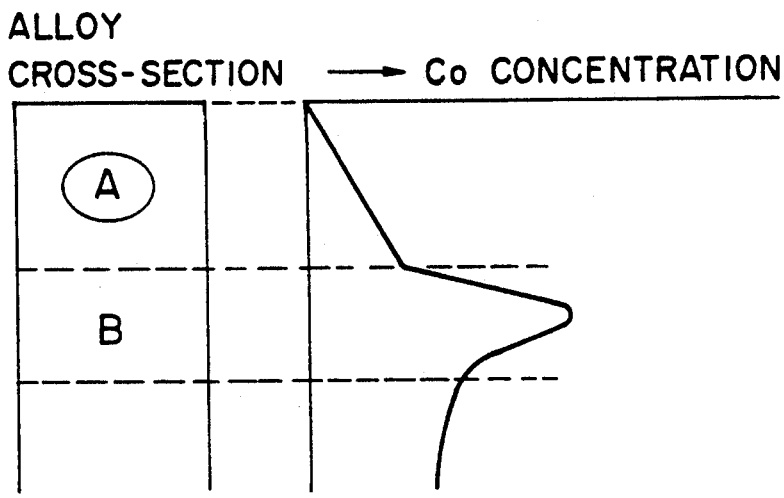
FIG. 5(*a*) is a cross-sectional view of one embodiment of the cemented carbide according to the present invention to show the properties thereof and FIG. (*b*) is an enlarged view of a zone A in FIG. 5(*a*).
Figure 5B:
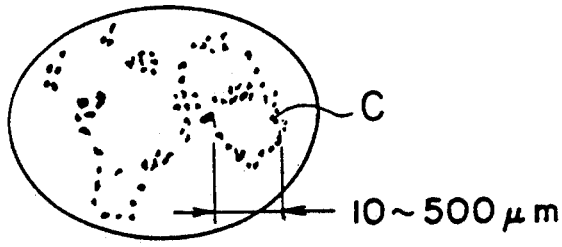

(5) In the zone from the surface to the binder phase-enriched layer, there are formed a binder phase-enriched line such that the binder phase is in granular form with a size of 10 to 500 μm and within this line, a part composed of a WC phase, at least one member selected from the group consisting of carbides, nitrides and carbonitrides of Group IVb, Vb and VIb metals of the Periodic Table and a binder phase in a smaller amount than that in the interior of the cemented carbide. FIG. 5(*a*) is a cross-sectional view of the cemented carbide alloy with a graph showing the state of change of Co concentration with the depth from the surface of the alloy and B designates the Co-enriched layer. FIG. 5(*b*) is an enlarged view of a zone A in FIG. 5(*a*), in which the Co-enriched line C surrounds an area in a granular form with a size of 20 to 500 μm.

(6) The surface of the cemented carbide is coated with a monolayer or multilayer, provided thereon, consisting of at least one member selected from the group consisting of carbides, nitrides, oxides and borides of Group IVb, Vb and VIb metals of the Periodic Table, solid solutions thereof and aluminum oxide.

The feature (1) gives an effect of maintaining the toughness of the cemented carbide by the binder phase-enriched layer present beneath the surface. In particular, this layer is present immediately beneath the binder phase-depleted layer given by the feature (4), i.e., the hardness-increased layer and thus serves to moderate the lowering of the toughness of the latter layer. There are pores inside the binder phase-enriched layer. The pores are not related to the lowering of the toughness because of the presence of the binder phase-enriched layer and the feature (4) serves to improve the wear resistance. High compression stress can be formed on the surface of the cemented carbide by both the features (1) and (4). The layer of the feature (1) is preferably in the range of 0.01 to 2 mm, preferably 0.05 to 1.0 mm, since if less than 0.01 mm, the wear resistance of the surface is lowered, while if more than 2 mm, the toughness is not so improved. The hardened layer of the feature (4) comprises the lower structure composed of WC phase, the other hard phase containing e.g., a Group IVb compound and a binder phase in a smaller amount than that in the interior of the cemented carbide, surrounded by a line wherein the binder phase is partially enriched in granular form, as shown by the feature (5), whereby the toughness can further be improved.

When the quantity of the binder phase in the binder phase-enriched layer is larger, the pores are sometimes not formed in the interior part. Furthermore, the hardness distribution over three zones toward the inside, as shown by the feature (2), is given by the structures of the features (1) and (4).

Preferably, the hardness distribution shown in the feature (2) is represented by a hardness change of 10 to 20 kg/mm$^2$ in Zone (a) and a hardness change of 100 to 1000 kg/mm$^2$ in Zone (b). If there is no Zone (a), the wear resistance is lacking and a large tensile stress occurs in the binder phase-enriched zone of the inside.

When a high toughness is particularly required, it is preferable to use a cemented carbide consisting of WC and an iron group metal. In this case, in the cemented carbide consisting of WC and an iron group metal, at least one member selected from the group consisting of Ti, Ta, Nb, V, Cr, Mo, Al, B and Si is dissolved in the binder phase in a proportion of 0.01% by weight to the upper limit of the solid solution and there is formed a layer in which the quantity of the binder phase is reduced to be less than the mean quantity of the binder phase in the interior part of the alloy in the outside part of the alloy surface and a layer in which the quantity of the binder phase is increased between the above described layer and the central part of the alloy, whereby a high toughness is given.

In addition, the surface of the cemented carbide is coated with a monolayer or multilayer consisting of at least one member selected from the group consisting of carbides, nitrides, oxides and borides of Group IVb, Vb and VIb metals of the Periodic Table, solid solutions thereof, and aluminum oxide.

The cemented carbide substrate of the present invention can be prepared by heating or maintaining a compact or sintered body having a density of 50 to 99.9% by weight in a carburizing atmosphere or carburizing and nitriding atmosphere in a solid phase, in solid-liquid phase or through a solid phase to a solid-liquid phase and then sintering it in the solid-liquid phase.

The details of the production principle of the cemented carbide according to the present invention is not clear, but can be understood as follows:

When a compact or incompletely sintered body is heated or maintained at a constant temperature in a carburizing atmosphere, the carbon content in the surface of the compact or incompletely sintered body is increased and when only the surface has a carbon content capable of causing a liquid phase, the binder phase is melted on only the surface part. When the compact or incompletely sintered body is heated or maintained at a constant temperature, furthermore, the melt of the binder phase passes through gaps in the compact or incompletely sintered body by action of the surface tension or shrinkage of the liquid phase and begins to remove inside. The removing of the melt is stopped when the liquid phase occurs in the interior part of the alloy and the removing space disappears. Consequently, the binder phase is decreased in the alloy surface when the solidification is finished and there is formed a binder phase-enriched layer between the surface layer and the interior part.

The enrichment of the binder phase begins simultaneously with the occurrence of the liquid phase, and reaches a maximum with the occurrence of a liquid phase in the interior part of the alloy and homogenization of the binder phase then proceeds with the progress of sintering. Therefore, it is preferable to prepare an incompletely sintered body having A-type or B-type pores in the interior part of the alloy. Up to the present time, such pores or cavity of the alloy have been considered harmful. In the case of a cutting tool, however, it is found that the performance depends on the alloy property at a position of about 1 mm beneath the surface and the toughness of the alloy is not lowered, but rather is improved by the binder phase-enriched layer according to the present invention. The present invention is based on this finding. According to the classification of Choko Kogu Kyokai (Cemented Carbide Association), the A-type includes pores with a size of less than 10 μm and the B-type includes pores with a size of 10 to 25 μm. Preferably, the pores are uniformly dispersed, in particular, in a proportion of at most 5%.

Furthermore, the pores inside the binder phase-enriched layer can be extinguished by increasing the quantity of the binder phase in the alloy and in cemented carbides consisting of WC and iron group metals, in particular, the hardened distribution in the alloy can be controlled by incorporating an iron group metal such as Ti, in the binder phase.

In a preferred embodiment of the present invention, a very small amount of Ti or another iron group metal(s) is incorporated in the alloy and causes a liquid phase while forming the corresponding carbide, carbonitride or nitride during the step of carburization or the step of carburization and nitrification. When the cemented carbide is sintered in vacuo at a temperature of at least the carburization temperature or the carburization and nitrification temperature, the carbide, carbonitride or nitride of Ti is decomposed and dissolved in the liquid phase. That is, the amount of solute atoms dissolved in the binder is increased to decrease the amount of the liquid phase to be generated. Consequently, homogenization of the binder phase distribution with progress of the sintering can be suppressed and the binder phase-enriched layer can be left over beneath the surface. The quantity of Ti, etc. to be added to the binder phase is in the range of 0.03% by weight to the limit of the solid solution, preferably 0.03 to 0.20% by weight, since if it is less than 0.01%, the effect of the addition is little, while if more than the limit of the solid solution, carbide, nitride or carbonitride grains of Ti, etc. are precipitated in the alloy and are sources of stress concentration, thus resulting in lowering of the strength. As the carburization atmosphere, there are used hydrocarbons, CO and mixed gases thereof with $H_2$, and as the nitriding atmosphere, there are used gases containing nitrogen such as $N_2$ and $NH_3$. If the density of the sintered body is less than 50%, the pores are too excessive or large to remove the binder phase, while if more than 99.9%, the pores are too small to remove the melted binder phase.

The range of the depth and width of the binder phase-enriched layer near the alloy surface can be controlled by sintering in a nitriding atmosphere or by processing in a carburizing atmosphere or a carburizing and nitriding atmosphere and then temperature-raising in a nitriding atmosphere at a temperature of from the processing temperature to 1450° C. If the temperature 1450° C., homogenization of the binder phase proceeds, which should be avoided.

In a further embodiment of the present invention, the cemented carbide contains $N_2$ in a proportion of 0.00 to 0.10% by weight. If it is more than 0.10%, free carbon is precipitated. This is not preferable. The quantity of $N_2$ is preferably at most 0.05%.

In the cemented carbide of the present invention, free carbon is sometimes precipitated in the range of from the surface to the binder phase-enriched layer. In this case, good results can be given, since the alloy surface can be coated with a hard layer without forming a decarburized layer. Furthermore, compressive stress is caused on the alloy surface, so that the alloy strength is not lowered even by precipitation of free carbon.

There has been proposed U.S. Pat. No. 4,843,039 similar to the present invention, in which the $\eta$ phase is present in the central part of the alloy and carburization is thus carried out to achieve the object. However, the strength of the alloy is decreased too much to be put to practical use under cutting conditions needing a high feed quantity and high fatigue strength.

In the present invention, moreover, the coating layer is formed by the commonly used CVD or PVD method.

The following examples are given in order to illustrate the present invention in greater detail without limiting the same.

EXAMPLE 1

A powder mixture having a composition by weight of WC-5% TiC-5% TaC-10% Co was pressed in an insert with a shape of CNMG 120408, heated to 1250° C. in vacuum, heated at a rate of 1° C./min, 2° C./min and 5° C./min to 1290° C. in an atmosphere of $CH_4$ at 0.5 torr and maintained for 30 minutes, thus obtaining Samples A, B and C.

The resulting alloys each were used as a substrate, coated with an inner layer of 5 μm Ti and an outer layer of 1 μm $Al_2O_3$ and then subjected to cutting tests under the following conditions. In Samples A, B and C, there were formed Co-enriched layers respectively at a depth of 1.5 mm, 1.0 mm and 0.5 mm beneath the surface and pores of A-type uniformly inside the Co-enriched layers. The Co-enriched layer contained Co in an amount of 2 times as much as the interior part, on the average, and the surface layer beneath the surface to the Co-enriched layer had a decreased Co content by 30% on the average.

| Cutting Conditions (1) for Wear Resistance Test | | | |
|---|---|---|---|
| Cutting Speed | 30 m/min | Workpiece | SCM 415 |
| Feed | 0.65 mm/rev | Cutting Time | 20 minutes |
| Cut Depth | 2.0 mm | | |

| Cutting Conditions (2) for Toughness Test | | | |
|---|---|---|---|
| Cutting Speed | 100 m/min | Workpiece | SCM 435, 4 grooves |
| Feed | 0.20–0.40 mm/rev | Cutting Time | 30 seconds |
| Cut Depth | 2.0 mm | Repeated 8 times | |

The test results are shown in Table 1, with those of the ordinary alloy of WC-5% TC-5% TaC10% Co for comparison:

TABLE 1

| Sample No. | Test (1) Flank Wear (mm) | Test (2) Breakage Ratio (%) |
|---|---|---|
| A | 0.14 | 45 |
| B | 0.18 | 35 |
| C | 0.28 | 15 |

TABLE 1-continued

| Sample No. | Test (1) Flank Wear (mm) | Test (2) Breakage Ratio (%) |
|---|---|---|
| Comparative Sample | broken in 5 minutes | 90 |

EXAMPLE 2

A powder mixture having a composition by weight of WC-5% TiC-5% TaC-10% Co was pressed in an insert with a shape of CNMG 120408, heated to 1250° C. in vacuum, heated at a rate of 1° C./min, 2° C./min and 5° C./min to 1290° C. in an atmosphere of $CH_4$ at 0.5 torr and maintained for 30 minutes, thus obtaining Samples D, E and F.

Thereafter, each of the samples was heated to 1350° C. in vacuum, maintained for 30 minutes.

The resulting alloys each were used as a substrate, coated with an inner layer of 5 μm Ti and an outer layer of 1 μm $Al_2O_3$ and then subjected to cutting tests under the following conditions. In Samples D, E and F, there were formed Co-enriched layers respectively at a depth of 1.5 mm, 1.0 mm and 0.5 mm beneath the surface and pores of A-type uniformly inside the Co-enriched layers. The Co-enriched layer contained Co in an amount of 2 times as much as the interior part, on the average, and the surface layer beneath the surface to the Co-enriched layer had a decreased Co content by 30% on the average.

| Cutting Conditions (1) for Wear Resistance Test | | | |
|---|---|---|---|
| Cutting Speed | 350 m/min | Workpiece | SCM 415 |
| Feed | 0.65 mm/rev | Cutting Time | 20 minutes |
| Cut Depth | 2.0 mm | | |

| Cutting Conditions (2) for Toughness Test | | | |
|---|---|---|---|
| Cutting Speed | 100 m/min | Workpiece | SCM 435, 4 grooves |
| Feed | 0.20–0.40 mm/rev | Cutting Time | 30 seconds |
| Cut Depth | 2.0 mm | Repeated 8 times | |

The test results are shown in Table 2, with those of the ordinary alloy of WC-5% TC-5% TaC-10% Co for comparison:

TABLE 2

| Sample No. | Test (1) Flank Wear (mm) | Test (2) Breakage Ratio (%) |
|---|---|---|
| D | 0.13 | 35 |
| E | 0.17 | 30 |
| F | 0.24 | 12 |
| Comparative Sample | broken in 5 minutes | 90 |

EXAMPLE 3

A compact (CNMG 120408) with an alloy composition of WC-15% TiC-5% TaC-10% Co was previously sintered at 1250° C., 1280° C. and 1300° C. in vacuum to give respectively a density of 80%, 90% and 95%, heated to 1250° C. at a rate of 2° C./min, maintained at 1310° C. for 40 minutes in an atmosphere of 10% of $CH_4$ and 90% of $N_2$ at 2 torr and then sintered in vacuum at 1360° C. for 30 minutes. In the resulting alloys, the depths to the Co-enriched layers were respectively 0.6, 1.2 and 1.8 mm (G, H, I).

Each of these samples was used as a substrate, coated with the same film as that of Example 1 and subjected to Test (2). Consequently, Samples G, H and I showed respectively a breakage ratio of 10%, 30% and 50%. In the Co-depleted layers near the surface of the alloy, there were a number of zones each consisting of WC, TiC, and TaC with a depleted quantity of Co by about 30% in comparison with the interior of the alloy, each being surrounded by Co-enriched lines and each having a size of about 300 μm, 200 μm and 100 μm. Analysis of Samples G, H and I showed that each of them contained 0.02% of nitrogen.

EXAMPLE 4

A compact (CNMG 120408) with an alloy composition of WC-15% TiC-5% TaC-10% Co was previously sintered at 1250° C., 1280° C. and 1300° C. in vacuum to give respectively a density of 80%, 90% and 95%, heated to 1250° C. at a rate of 2° C./min, maintained at 1310° C. for 40 minutes in an atmosphere of 10% of $CH_4$ and 90% of $N_2$ at 2 torr. In the resulting alloys, the depths to the Co-enriched layers were respectively 0.6, 1.2 and 1.8 mm (J, K, L).

Each of these samples was used as a substrate, coated with the same film as that of Example 1 and subjected to Test (2). Inside the Co-enriched layer, there was A-type pores in the case of Samples J and K, and A-type pores and B-type pores in uniformly mixed state in the case of Sample L. Consequently, Samples J, K and L showed respectively a breakage ratio of 10%, 30% and 50%. In the Co-depleted layers near the surface of the alloy, there were a number of zones each consisting of Wc, TiC and TaC with a depleted quantity of Co by about 30% in comparison with the interior of the alloy, each being surrounded by Co-enriched lines and each having a size of 300 μm, 200 μm and 100 μm.

EXAMPLE 5

A powder mixture having an alloy composition of WC-15% TiC-5% TaC-11%Co was pressed in an insert with a shape of CNMG 120408, heated to 1290° C. in vacuum, maintained for 30 minutes to obtain a sintered body with a density of 99.0% and then maintained in a mixed gas of $CH_4$ and $H_2$ of 1.0 torr for 10 minutes, followed by cooling.

Figure 1:
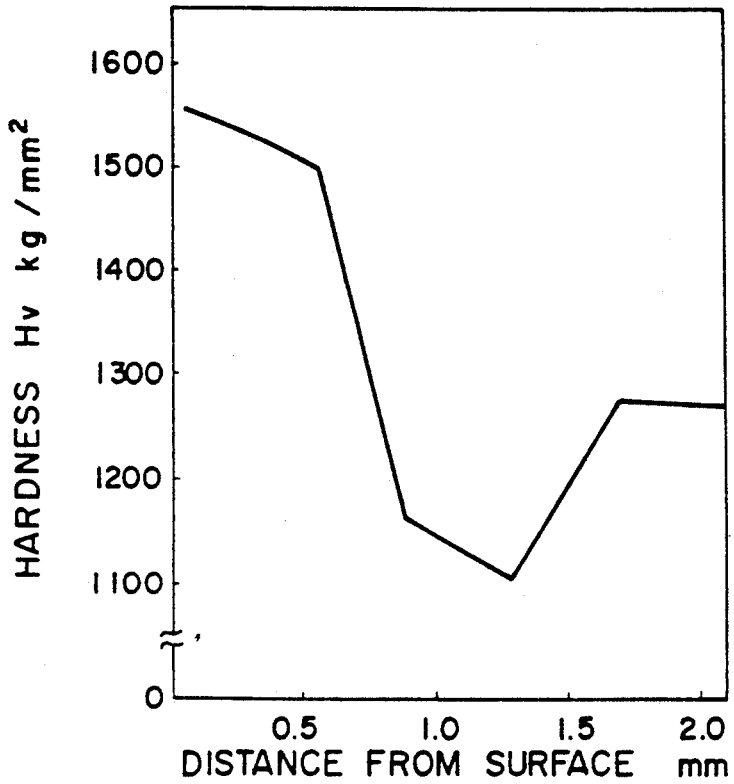
FIG. 1 is a graph showing the hardness (Hv) distribution of an alloy obtained in Example 5.
Figure 2:
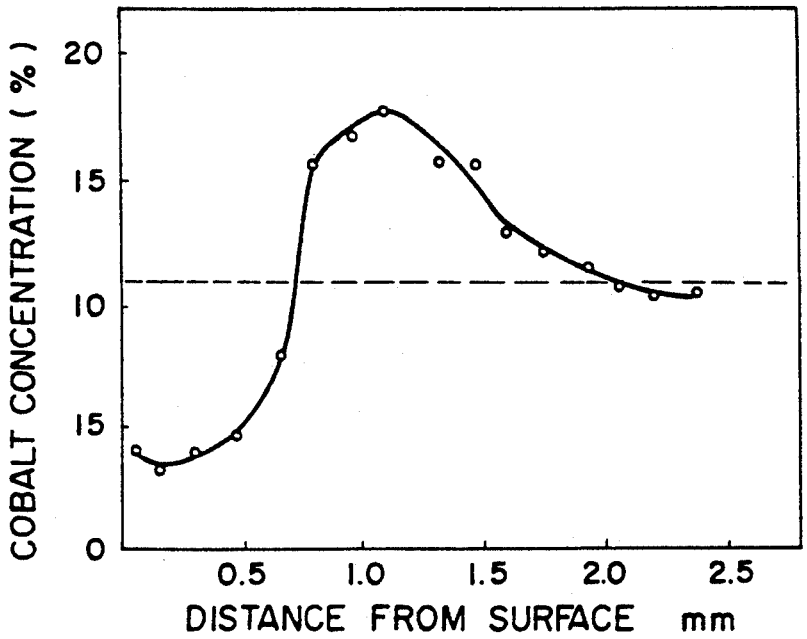
FIG. 2 is a graph showing the Co concentration distribution of an alloy obtained in Example 5.

The resulting alloy was used as a substrate and coated with inner layers of 3 μm TiC and 2 μm TiCN and an outer layer of $Al_2O_3$ by the ordinary CVD method. The Hv hardness distribution (load: 500 g) is shown in FIG. 1 and the Co concentration from the surface, analyzed by EPMA (accelerating voltage 20 KV, sample current 200 A, beam diameter 100 μm), is shown in FIG. 2.

In this alloy, there were A-type pores uniformly within a range of 2.0 mm beneath the surface. When this alloy was subjected to a cutting test under the same conditions as in Example 1, there were obtained results of a flank wear of 0.12 mm in Test (1) and a breakage ratio of 10% in Test (2).

EXAMPLE 6

A powder mixture having a composition of WC-20% Co-5% Ni containing 0.1% of Ti based on the binder phase was pressed in a predetermined shape, heated from room temperature in vacuum and subjected to temperature raising from 1250° C. to 1310° C. in an atmosphere of $CH_4$ of 0.1 torr or a mixed gas of 10% of $CH_4$ and 90% of $N_2$ of 5 torr respectively at a rate of 2° C./min. When the temperature raising was stopped at 1310° C., an incomplete sintered body of 99% was obtained. The resulting alloy was further heated to 1360° C. in vacuum, maintained for 30 minutes and cooled to obtain Samples M and N.

Figure 3:
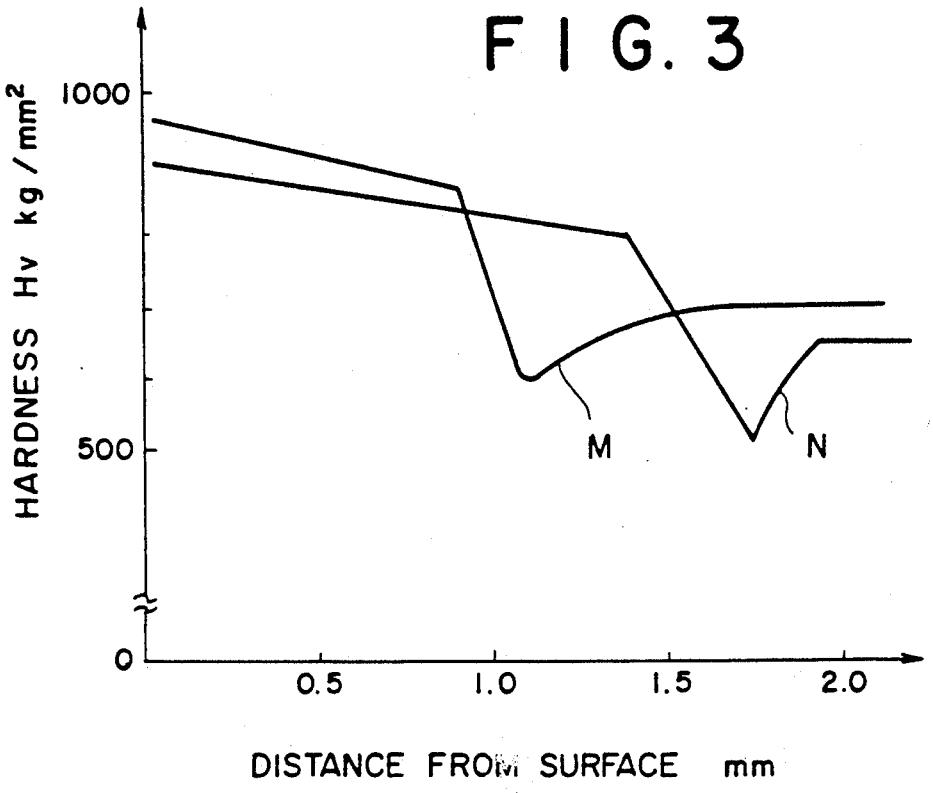
FIG. 3 is a graph showing the hardness distribution of alloys M and N obtained in Example 6.

The hardness distribution (load 500 g) of this alloy is shown in FIG. 3 and the amounts of carbon (TC) and $N_2$ in Samples M and N are shown in the following Table 3. The quantity of the binder phase was depleted in the surface layer by 40% as little as in the interior part of the alloy and increased in the binder-enriched layer by 40%.

TABLE 3

| Sample No. | Total Carbon (%) | $N_2$ (%) |
|---|---|---|
| M | 4.55 | less than 0.001 |
| N | 4.52 | 0.01 |

EXAMPLE 7

Figure 4:
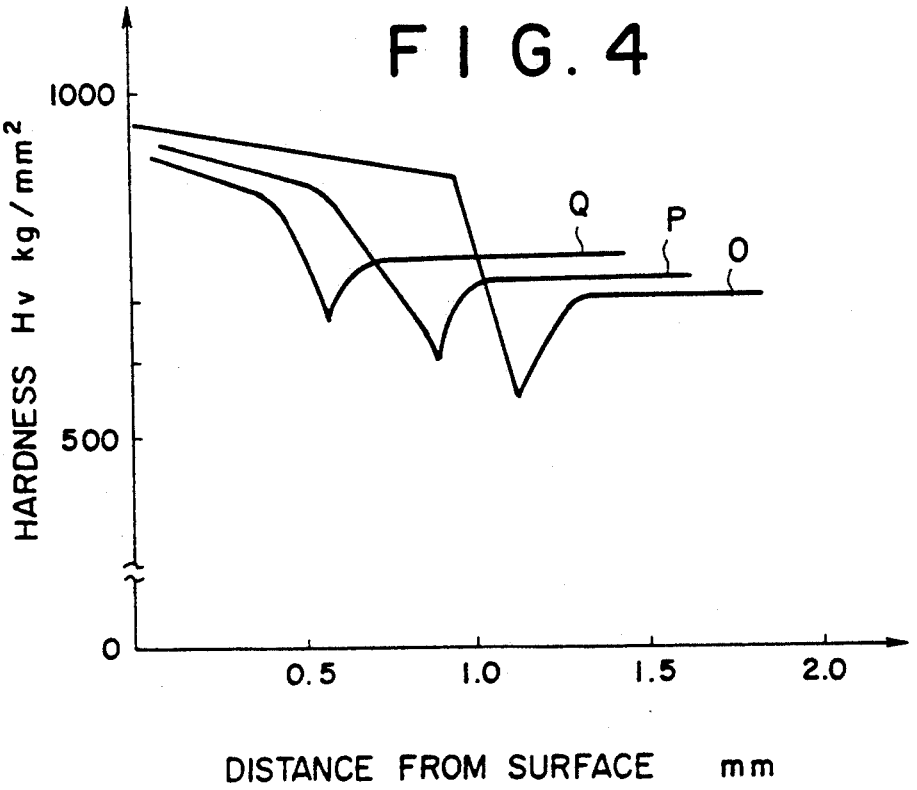
FIG. 4 is a graph showing the hardness distribution of alloys O, P and Q obtained in Example 7.

A powder mixture having an alloy composition of WC-20% Co-5% Ni containing 0.10% of Ti, 0.5% of Ta or 0.2% of Nb in the binder phase was pressed in a predetermined shape, heated to obtain an incomplete sintered body of 99%, then maintained in a mixed gas of 10% of $CH_4$ and 90% of $N_2$ of 5 torr for 30 minutes, heated at a rate of 5° C./min from 1310° C. to 1360° C. in $N_2$ at 20 torr and maintained at 1360° C. in vacuum. The resulting alloys had hardness distributions as shown in FIG. 4 and $N_2$ contents of 0.03%, 0.07% and 0.04% (Sample Nos. O, P and Q).

EXAMPLE 8

The alloys prepared in Examples 6 and 7, M, N, O, P and Q were subjected to a Charpy impact and toughness test, thus obtaining results as shown in Table 4.

TABLE 4

| No. | Span 40 mm, Capacity 0.4 kg, 4 × 4 × 8, Notch-free ($kgm/cm^2$) |
|---|---|
| M | 2.8 |
| N | 2.7 |
| O | 2.5 |
| P | 2.1 |
| Q | 2.0 |

The ordinary alloy having a hardness of 750 $kg/mm^2$ uniformly through the alloy exhibited a strength of 1.6 $kgm/cm^2$.

EXAMPLE 9

The alloys of M and N, obtained in Example 6, were formed in a predetermined punch shape and subjected to a life test by working SCr 21 in an area reduction of 58% and an extrusion length of 10 mm.

After working 20,000 workpieces, Samples M and N could further be used with a very small quantity of wearing and hardly meeting with breakage, while the ordinary alloy wore off or broken even after working only 2000 to 5000 workpieces.

Using the cemented carbides of the present invention, cutting tools and wear resisting tools can be obtained which are capable of maintaining excellent wear resistance as well as high toughness even under working conditions with a high efficiency that the prior art cannot achieve. According to the present invention, furthermore, cemented carbides, very excellent in toughness and wear resistance, can be produced in an efficient manner.

What is claimed is:

1. A process for the production of a surface-coated cemented carbide comprising:
   a) preparing a substrate for the surface-coated cemented carbide by the sequential steps of:
      i) compacting or sintering at least one member from a group consisting of carbides, nitrides and carbonitrides of Group IVa, Va and VIa metals of the Periodic Table and a binder consisting of at least one member selected from iron group metals into a body having a density of 50 to 99.9% by weight, and
      ii) heating or maintaining the body in a carburizing atmosphere or in a carburizing and nitriding atmosphere in a solid phase, in a solid-liquid phase or through a solid phase to a solid-liquid phase, wherein a binder phase-enriched layer is formed in a space between 0.1 mm and 2 mm below the surface of the substrate and there are pores of A-type or B-type or mixtures of A-type and B-type pores inside the binder phase-enriched layer, and
   b) coating the substrate with monolayer or multilayer consisting of at least one member selected from the group consisting of carbides, nitrides, oxides and borides of Group IVa, Va and VIa metals of the Periodic Table, solid solutions thereof, and aluminum oxide.

2. A process for the production of a surface-coated cemented carbide comprising:
   a) preparing a substrate for the surface-coated cemented carbide by the sequential steps of:
      i) compacting or sintering at least one member from a group consisting of carbides, nitrides and carbonitrides of Group IVa, Va and VIa metals of the Periodic Table and a binder consisting of at least one member selected from iron group metals into a body having a density of 50 to 99.9% by weight, and
      ii) heating or maintaining the body in a carburizing atmosphere or in a carburizing and nitriding atmosphere in a solid phase, in a solid-liquid phase or through a solid phase to a solid-liquid phase,
      iii) heating in a nitriding atmosphere from the carburizing or carburizing and nitriding temperature in step ii) to 1450° C., wherein a binder phase-enriched layer is formed in a space between 0.01 mm and 2 mm below the surface of the substrate, and
   b) coating the substrate with a monolayer or a multilayer consisting of at least one member selected from the group consisting of carbides, nitrides, oxides and borides of Group IVa, Va and VIa metals of the Periodic Table, solid solutions thereof, and aluminum oxide.

3. A process for the production of a surface-coated cemented carbide comprising:
   a) preparing a substrate for the surface-coated cemented carbide by the sequential steps of:
      i) compacting or sintering at least one member from a group consisting of carbides, nitrides and carbonitrides of group IVa, Va and VIa metals of the Periodic Table and a binder consisting of at least one member selected from iron group metals into a body having a density of 50 to 99.9% by weight, and ii) heating or maintaining the body in a carburizing atmosphere or in a carburizing and nitriding atmosphere in a solid phase, in a solid-liquid phase or through a solid phase to a solid-liquid phase, and iii) sintering the body in a vacuum while heating from the carburizing or carburizing and nitriding temperature in step ii) to 1450° C., wherein a binder phase-enriched layer is formed in a space between 0.01 mm and 2 mm below the surface of the substrate, and b) coating the substrate with a monolayer or a multilayer consisting of at least one member selected from the group consisting of carbides, nitrides, oxides and borides of Group IVa, Va and VIa metals of the Periodic Table, solid solutions thereof, and aluminum oxide.

* * * * *